US007083470B2

(12) United States Patent
Zhang et al.

(10) Patent No.: US 7,083,470 B2
(45) Date of Patent: Aug. 1, 2006

(54) ELECTRICAL CONNECTOR WITH IMPROVED SHIELDING MEMBER

(75) Inventors: Chi Zhang, Kunsan (CN); Ren-Chih Li, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/144,927

(22) Filed: Jun. 3, 2005

(65) Prior Publication Data

US 2006/0040559 A1 Feb. 23, 2006

(30) Foreign Application Priority Data

Aug. 19, 2004 (CN) ..... 2004 2 00788933

(51) Int. Cl.
*H01R 13/648* (2006.01)

(52) U.S. Cl. ..... 439/609

(58) Field of Classification Search ..... 439/607–610
See application file for complete search history.

(56) References Cited

U.S. PATENT DOCUMENTS 5,201,675 A * 4/1993 Igarashi et al. ..... 439/607
5,584,727 A * 12/1996 Miller et al. ..... 439/607
5,637,015 A * 6/1997 Tan et al. ..... 439/607
5,921,814 A 7/1999 Maruyama
6,168,467 B1 * 1/2001 Chiou ..... 439/607
6,485,328 B1 * 11/2002 Wu ..... 439/567
6,551,139 B1 * 4/2003 Yu ..... 439/607
6,749,463 B1 * 6/2004 Fan ..... 439/607
6,755,671 B1 * 6/2004 Fan et al. ..... 439/108
6,918,777 B1 * 7/2005 Fan ..... 439/135
6,948,954 B1 * 9/2005 Fan ..... 439/137
6,954,363 B1 * 10/2005 Fan ..... 361/816
7,008,267 B1 * 3/2006 Fan ..... 439/607
2005/0095913 A1 * 5/2005 Fan ..... 439/607
2005/0095914 A1 * 5/2005 Fan ..... 439/607
2005/0277334 A1 * 12/2005 Huang ..... 439/607
2005/0282437 A1 * 12/2005 Fan ..... 439/608

* cited by examiner

*Primary Examiner*—Ross Gushi
(74) *Attorney, Agent, or Firm*—Wei Te Chung

(57) ABSTRACT

An electrical connector comprising a housing (1) having a bottom wall and four upstanding walls (11,12,13) formed a mating cavity (15) adapted for receiving a plug portion of a complementary connector; a plurality of terminals (2) received in the housing and each having a contact portion (21) exposed in the mating cavity; and a metallic shielding member (3) comprising a plate portion surrounding outer surfaces of the upstanding walls and a folded portion (32) extending from the plate portion and attached to an inner surface of one upstanding wall, the folded portion provided with a latching resilient tab (321) unreturnably snapped into a gap defined in the inner surface of the upstanding wall when the shielding member is completely assembled onto the housing along a mating direction of the complementary connector.

19 Claims, 6 Drawing Sheets

ELECTRICAL CONNECTOR WITH IMPROVED SHIELDING MEMBER

BACKGROUND OF THE INVENTION

1. Field of the Invention

The present invention relates to an electrical connector, and more particularly to an electrical connector having an improved shielding member stably mounted on a housing of the electrical connector.

2. Description of Related Art

A conventional connector includes an insulate housing having a plurality of receiving passages and a plurality of contacts received in the housing. A shielding member is mounted on the housing and surrounds a substantial portion of the housing to protect the contacts from Radio Frequency or Electro-Magnetic Interference as well as protecting the surroundings from interference radiating from the connector. In some applications, for fully electrical contacting with the connector and a complementary connector, means usually provided on the shielding member is used for frictionally engaging with the complementary connector. Generally, after several mating and unmating cycles, the shielding member becomes easily broken off the housing. Therefore, sufficient and stable engagement between the shielding member and the housing is highly desired to meet frequent mating and unmating cycles.

U.S. Pat. No. 5,921,814 discloses a shielded electrical connector. The connector comprises an insulated housing and a metallic shielding member with three locking tabs provided on its sidewall. The locking tabs bent from the tops of each sidewall of the shielding member and extend downwardly within respective recesses defined on each outer surface of the housing. These locking tabs have holes for snapping over latch bosses projecting outwardly from outer surfaces of the recesses to lock the shielding member to the housing, and thus the shielding member is restricted to move relatively to the housing. However, frequently, these latch bosses have not adequate intensity to bear the force occurred in the mating and unmating process of the connector and becomes easily broken.

Therefore, it is desired to provide a shielded electrical connector with an improved shielding member which is stably mounted on a housing, and can bear great force occurred in the mating and unmating process of the connector.

SUMMARY OF THE INVENTION

An object of the present invention is to provide an electrical connector with an improved shielding member which performs a stable engagement with an insulate housing.

In order to achieve above-mentioned object, a connector in accordance with a preferred embodiment of the present invention includes a housing having a bottom wall, a pair of opposed longitudinal side walls and a pair of opposed transverse end walls which define a mating cavity for receiving a plug portion of a complementary connector; a plurality of contacts received in the housing and each having a contact portion exposed in the mating cavity to electrically contact with a conductor of the complementary connector; and a metallic shielding member mounted to the housing to protect the contacts from unexpected interference, the shielding member including a folded portion extending downwardly into the mating cavity and against an inner surface of the side wall or end wall, the folded portion having a latching resilient tab extending upwardly in the mating cavity and bending toward the inner surface of the side wall or the end wall. Until the shielding member fully mounted on the housing, the resilient tab are unreturnably snapped into a gap defined in the inner surface of the housing. When the complementary connector is pulled out of the connector, the resilient tab is blocked by the gap induce the shielding member hardly move relatively to the housing.

Other objects, advantages and novel features of the present invention will become more apparent from the following detailed description of the present embodiment when taken in conjunction with the accompanying drawings.

BRIEF DESCRIPTION OF THE DRAWINGS

FIG. 4 is an enlarged view of circled portion of FIG. 3; and

DETAILED DESCRIPTION OF THE INVENTION

Figure 1:
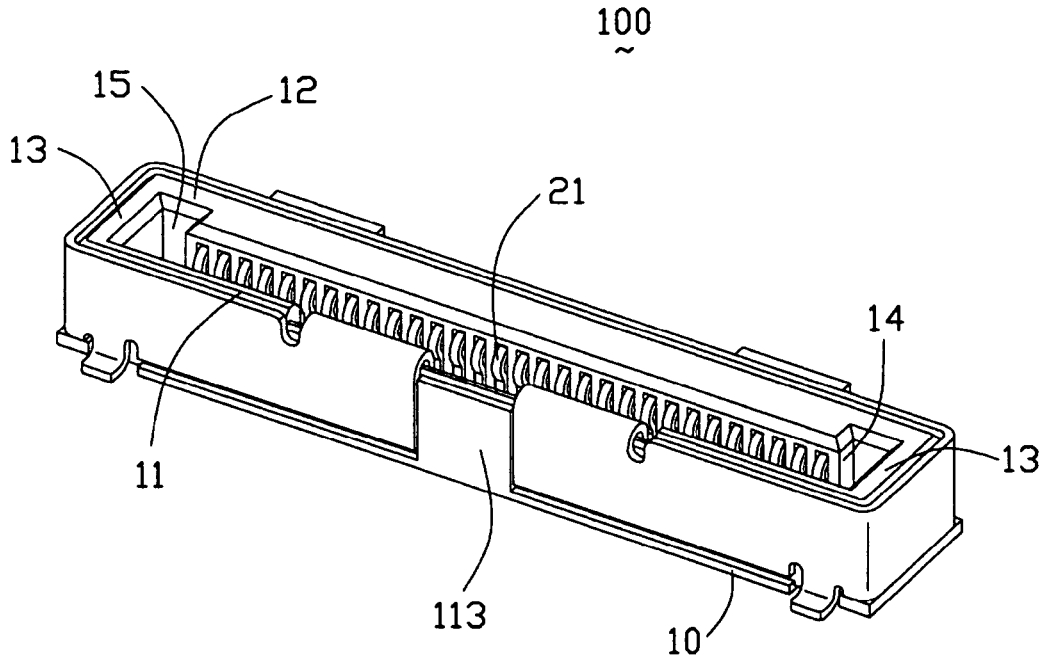
FIG. 1 is an assembled perspective view of an electrical connector in accordance with the preferred embodiment of the present invention.

Reference will now be made to the drawing figures to describe the preferred embodiment of the present invention in detail.

Figure 2:
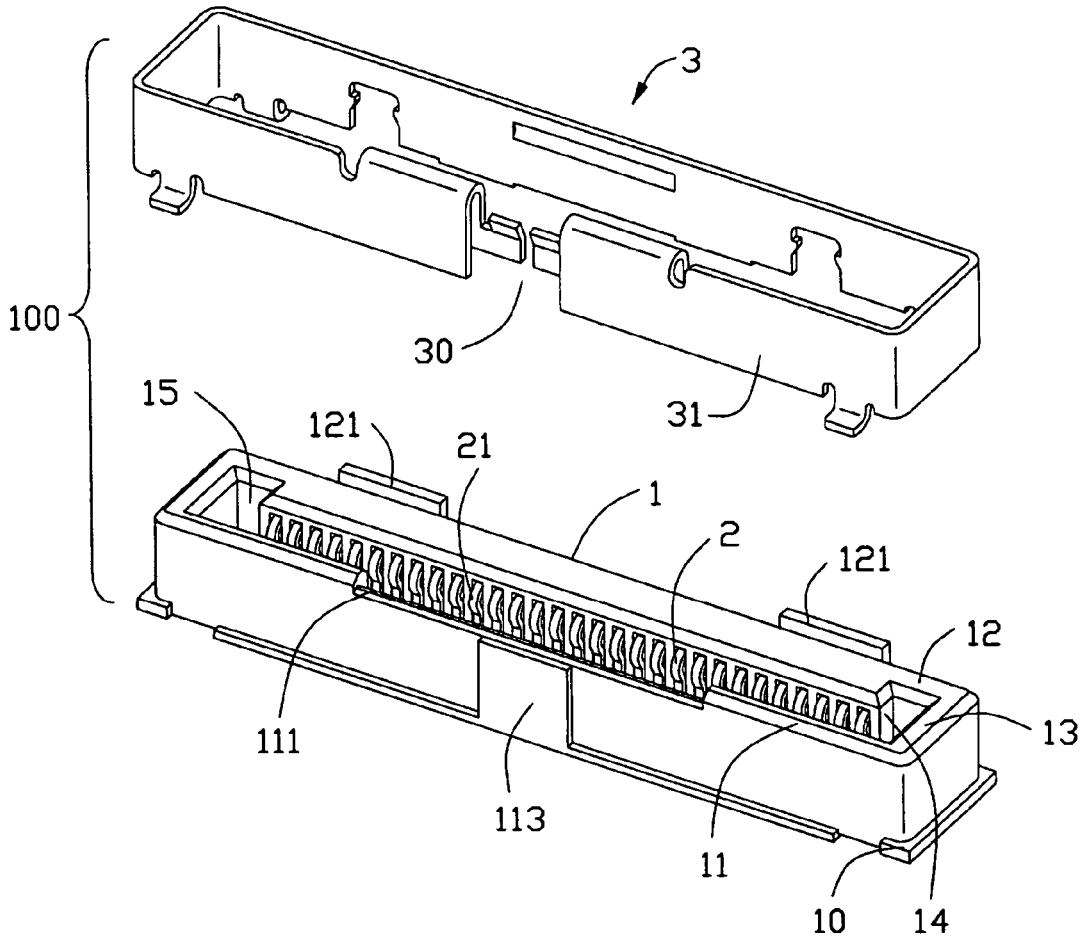
FIG. 2 is an partially exploded perspective view of the electrical connector of FIG. 1.

Referring to FIGS. 1 and 2, an electrical connector 100 in accordance with the present invention generally is a receptacle connector and comprises a insulated housing 1, a plurality of contacts 2 fixed in the housing 1 and a metallic shielding member 3 mounted on the housing for protecting the contacts 2 from unexpected interference.

Figure 4:
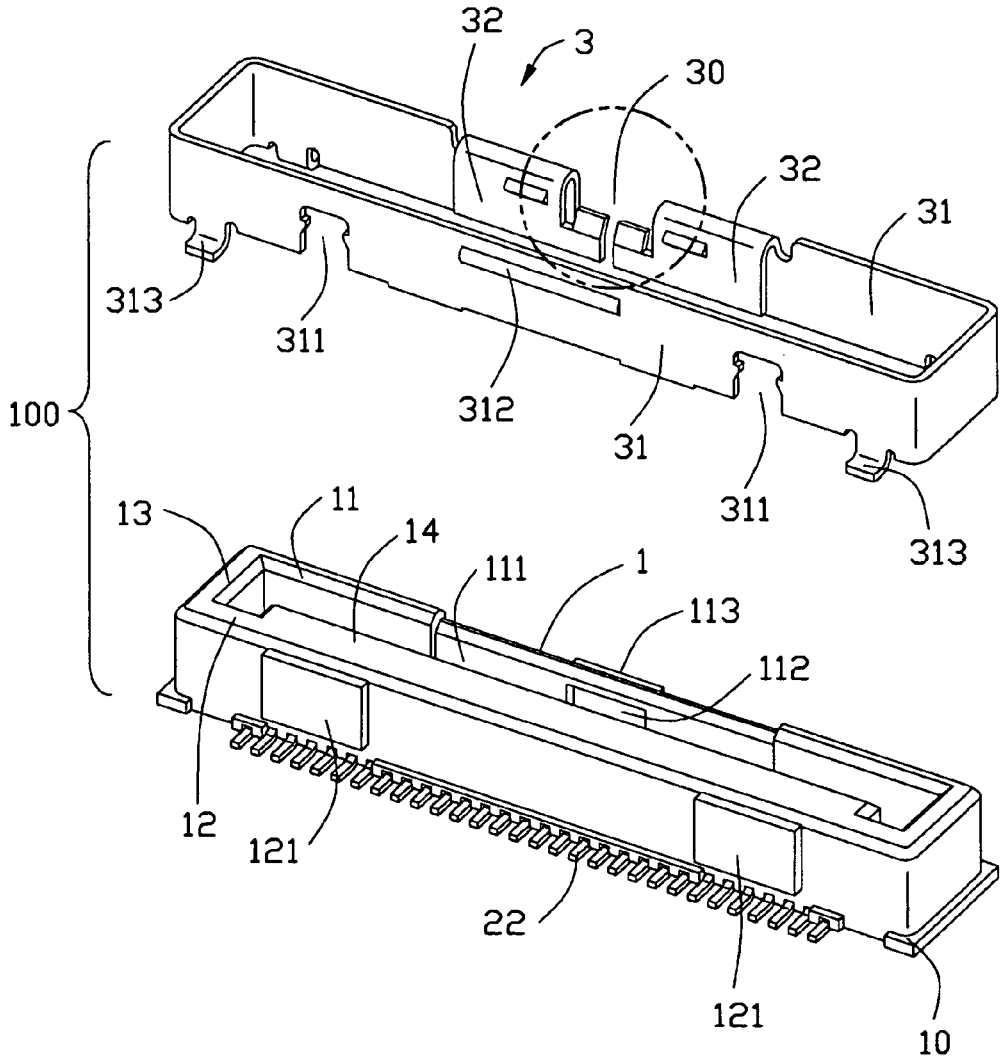
FIG. 4 is an exploded perspective view of the connector of FIG. 3.
Figure 5:
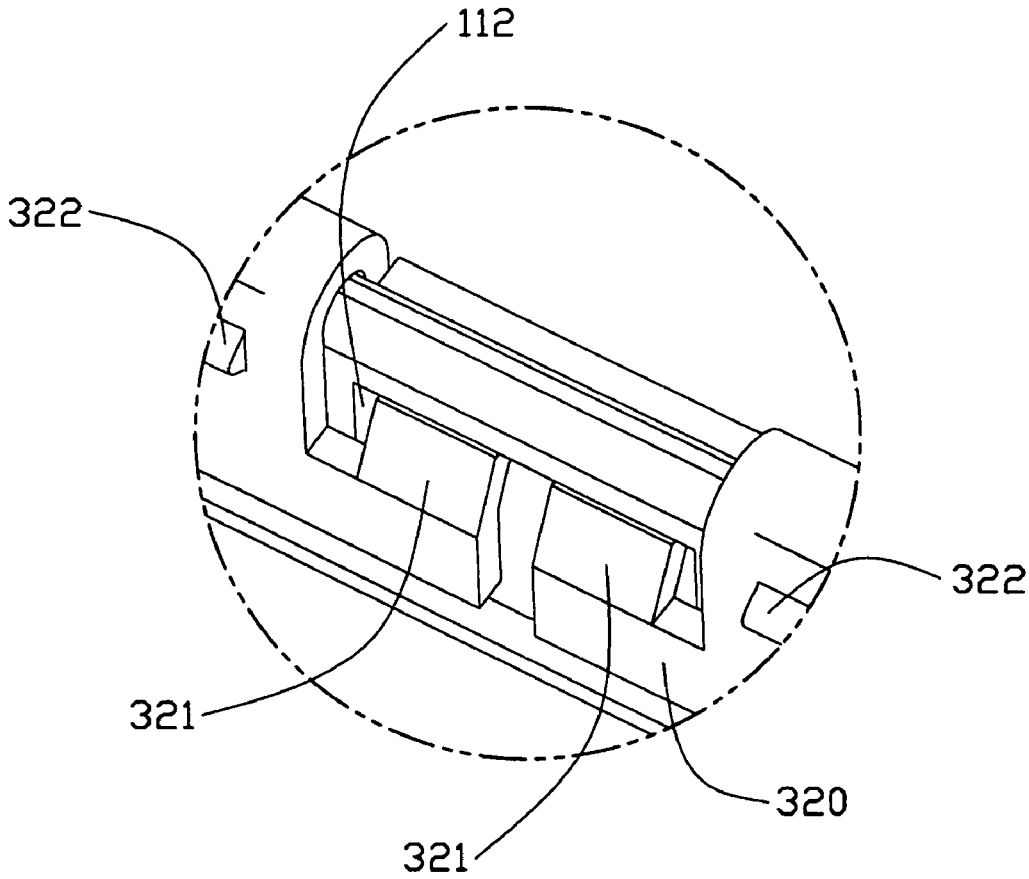
FIG. 5 is an enlarged view of circled portion of FIG. 4.
Figure 6:
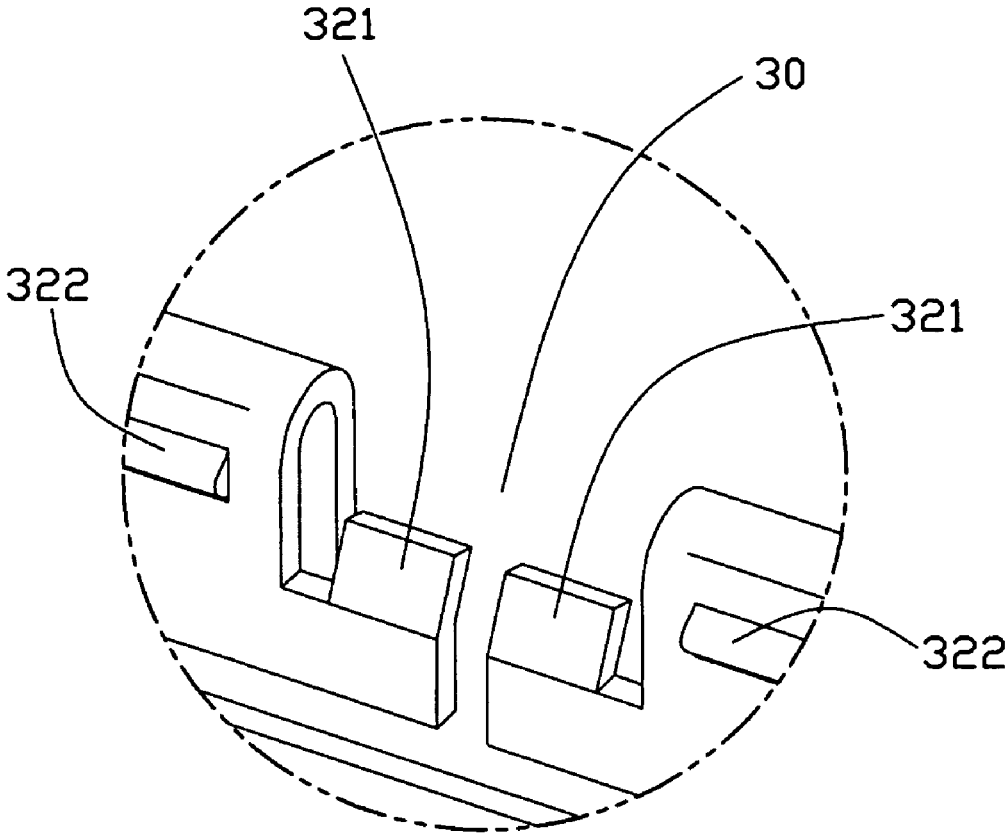

Referring to FIGS. 2 and 4, the housing 1 comprises four upstanding walls such as a first side wall 11, a second side wall 12 and a pair of end walls 13, and these upstanding walls connect with a bottom wall (not shown) to define a mating cavity 15 for receiving a plug portion of a complementary connector (not shown).

Figure 3:
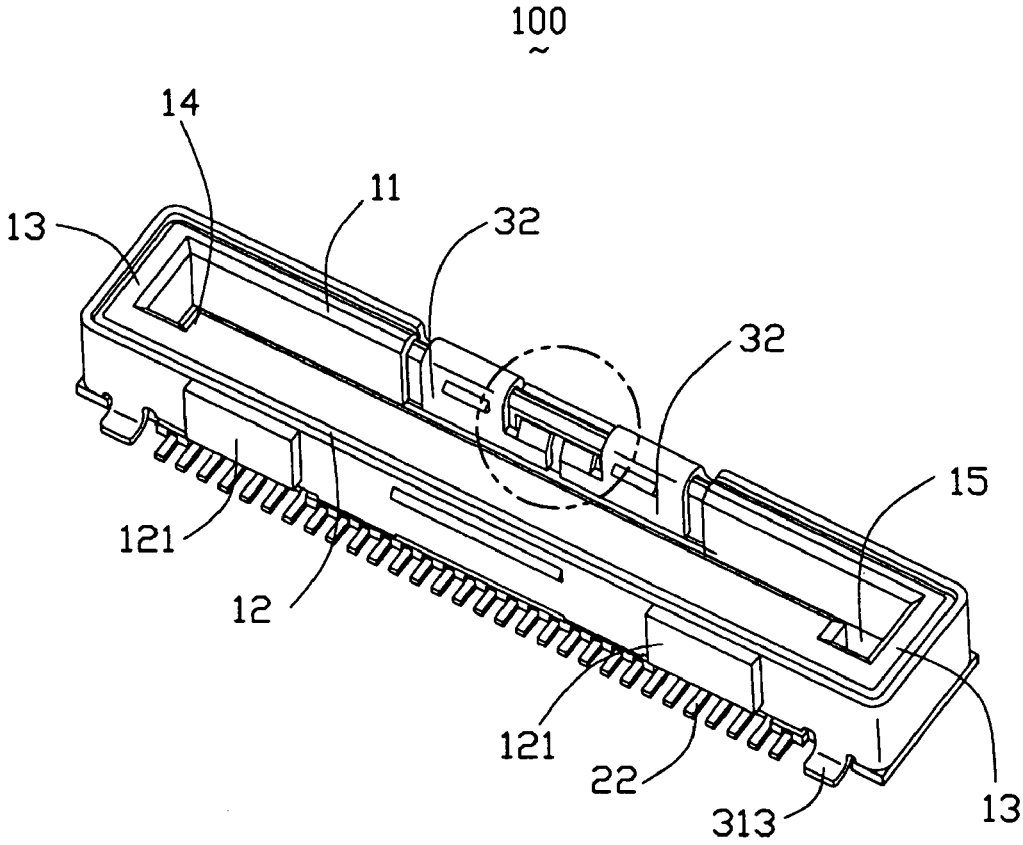
FIG. 3 is another assembled perspective view of the electrical connector of FIG. 1 taken from a second aspect.

The first side wall 11 has a hollow 111 at the middle thereof, and the hollow 11 is depressed from top and inner surface of the first side wall 11. At the middle of the hollow 11 defines a gap 112 opening to the mating cavity 15 and extending through the bottom wall of the housing 1 for facilitating to operation. The first side wall 11 further comprises a projection 113 defined on outer surface thereof and disposed oppositely to the gap 112. Specially, the depth of the hollow 111 and the height of the projection 113 are both the same as the thickness of the shielding member 3. Additionally, the second side wall 12 has a pair of retaining blocks 121 symmetrically disposed at end portions of an outer surface thereof and used for fixedly holding the shielding member 3 to the housing 1. These upstanding walls respectively has some slender flanges 10 disposed at bottom edges thereof and some clearances formed between each pair of slender flanges 10 to allow solder legs 313 of the shielding member 3 extending through (shown in FIG. 3), and wherein the flange 10 defined on the first side wall 11 is integrated with the projection 113.

The second side wall 12 has a protrusion 14 extending into the mating cavity 15 and a pair of grooves disposed at longitudinal ends of the protrusion. The grooves are communication with the mating cavity 15 so that the mating cavity 15 is in a "C" shaped structure. The protrusion 14 has a plurality of passages arranged in one row and opening to the mating cavity 15. The contacts 2 are fixed in the passages, and each contact 2 has a contact portion 21 exposed in the mating cavity 15 to electrically contact with a conductor of the complementary connector and a tail portion 22 for being soldered to a printed circuit board (not shown).

The shielding member 3 is bended by a single metal plate and comprises a plate portion 31 generally formed into an annular structure and surrounding outer surface of the upstanding walls to protect the contacts 2 from unexpected interference. The plate portion 31 has two opposite distal ends which are spaced a distance to form a hatch 30 thereby and lean against the hollow 111 of the first side wall 11. Each distal end has a folded portion 32 which strides over the top of the hollow 111 to extend downwardly and lean against the inner surface of hollow 111. However, the folded portions 32 also could extend from other portions of the plate portion 31. Referring to FIGS. 3 to 6, at lower edges of the folded portion 31 each has a horizontal portion which extends toward each other, and wherein each horizontal portion 320 defines a latching resilient tab 321 which extends upwardly and bends toward the inner surface of the first side wall 11, and the resilient tab 321 is finally to be unreturnably retained by the gap 112 when the shielding member 3 is completely mounted on the housing 1. For achieving a stable engagement between the connector 100 and the complementary connector, retaining means such as retaining tubers 322 provided on an inner surface of the folded portions 32 and retaining tubers 312 provided on the outer surface of the plate portion 31 applied for shielding the second side wall 12 are used to frictionally fit with corresponding portions of the complementary connector.

When the shielding member 3 is mounted to the housing 1 along a mating direction of the complementary connector, the resilient tabs 321 is tightly pressed by the first side wall 11 to produce elastic distortion. When the shielding member 3 is completely assembled onto the housing 1, the resilient tabs 321 are unreturnably snapped into the gap 112 of the inner surface of the first side wall 11, synchronously, retaining cutouts 311 defined on the plate portion 31 tightly mate with the retaining blocks 121. Bottom edges of the shielding member 3 is substantially of flat and supported by slender flanges 10 of the housing, and the solder legs 313 extending through the clearances between the flanges 10 to solder on the printed circuit board. When the connector 100 is pulled out the complementary connector, the shielding member 3 suffers from outside force to achieve a tendency of movement relative to the housing 1, however, the resilient tabs 321 are blocked by the gap 112 induce the shielding member 3 hardly move relatively to the housing 1 and not easily break off the housing 1.

However, the disclosure is illustrative only, changes may be made in detail, especially in matter of shape, size, and arrangement of parts within the principles of the invention.

What is claimed is:

1. An electrical connector comprising:

an insulated housing comprising a bottom wall and upstanding walls extending from the bottom wall which surrounding a mating cavity for receiving a plug portion of a complementary connector;

a plurality of electrical terminals fixed in the housing, each contact comprising a contact portion exposed in the mating cavity for electrically connecting with the complementary connector;

a metallic shielding member comprising a plate portion surrounding outer surfaces of the upstanding walls, and a folded portion extending from the plate portion and attached to an inner surface of one upstanding wall, the folded portion provided with a latching resilient tab originally sliding against said inner surface and finally unescapably snapped into a gap defined in the inner surface of the upstanding wall during assembling the shielding member onto the housing along a mating direction of the complementary connector.

2. The electrical connector as described in claim 1, wherein the folded portion extends from a top edge of the plate portion and strides over a top surface of the upstanding wall.

3. The electrical connector as described in claim 1, wherein the folded portion has retaining tubers thereon for achieving stable engagement between the connector and the complementary connector.

4. The electrical connector as described in claim 1, wherein the shielding member surrounding the housing, is essentially formed by a sheet metal having two far apposite longitudinal ends, when said shielding member is in a extended manner, while being closely opposite to each other round a middle portion of said inner surface when said shielding member is formed to surround said housing, and each of said longitudinal ends defines said folded portion.

5. The electrical connector as described in claim 1, wherein the upstanding walls comprises a pair of opposite longitudinal side walls, and the folded portion extends against an inner surface of one longitudinal side wall.

6. The electrical connector as described in claim 5, wherein the longitudinal side wall has a projection disposed on an outer surface thereof and opposite to the gap.

7. The electrical connector as described in claim 6, wherein said metallic shielding member defines two opposite end edges essentially terminated at said projection.

8. The electrical connector as described in claim 5, wherein the other longitudinal side wall has a protrusion projecting into the mating cavity and defining a plurality of passages arranged in one row for fixing the contacts therein.

9. The electrical connector as described in claim 8, wherein the other longitudinal side wall has a pair of grooves respectively disposed at longitudinal ends of the protrusion, and the grooves are communication with the mating cavity.

10. The electrical connector as described in claim 1, wherein the shielding member is bended by a metal place, and the plate portion is generally formed into an annular structure and has two distal ends extending toward each other.

11. The electrical connector as described in claim 10, wherein the folded portion extends from one distal end.

12. The electrical connector as described in claim 11, wherein one upstanding wall has a hollow displaced a location corresponding to the distal ends and depressed from top and inner surface thereof, and the folded portion fitly stride over the hollow to extending into the mating cavity.

13. An electrical connector comprising:

an insulated housing comprising a bottom wall and upstanding walls extending from the bottom wall, said bottom wall and said upstanding walls commonly defining a mating cavity for receiving a plug portion of a complementary connector, said upstanding walls including at least two opposite longitudinal side walls;

a plurality of electrical terminals fixed in the housing, each contact comprising a contact portion exposed in the mating cavity for electrically connecting with the complementary connector;

a metallic shielding member comprising a plate portion surrounding outer surfaces of the upstanding walls, and a folded portion extending from the plate portion and attached to an inner surface of one of said two longitudinal side walls, the folded portion provided with a latching portion latched to said inner surface for preventing upward movement of said shielding member along a mating direction during assembling said shielding member to the housing, and said plate portion further defining another latching portion latched around an outer surface of the other of said two longitudinal side walls.

14. The electrical connector as claimed in claim 13, wherein said another latching portion is attached to a retaining block formed on said other of the two longitudinal side walls.

15. The electrical connector as claimed in claim 14, wherein said shielding member is downwardly assembled to the housing along said mating direction of the complementary connector, and said folded portion and said another latching portion prevents excessive movement of said shielding member along said mating direction during assembling said shielding member to the housing.

16. An electrical connector comprising:

an insulative housing including a bottom wall with two opposite longitudinal side walls and two lateral side walls extending therefrom, said bottom wall and said longitudinal side walls and said lateral side walls commonly defining a cavity for receiving a complementary connector therein;

a protrusion formed on an inner surface of one of said longitudinal side walls, a plurality of contacts disposed in said protrusion with contact portions exposed to said cavity for engagement with the complementary connector;

a metallic shielding member including a plate portion essentially enclosing said longitudinal side walls and said lateral side walls; and a pair of folded portions extending from an upper edge of said plate portion around the other of said longitudinal side walls and into the cavity to abut against a corresponding inner surface of said other of the longitudinal side walls.

17. The electrical connector as claimed in claim 16, wherein said folded portions are equipped with latches to be secured to the corresponding inner surface.

18. The electrical connector as claimed in claim 16, wherein said pair of folded portions are discrete and separate from each other, and symmetrically arranged with each other relative to the housing.

19. The electrical connector as claimed in claim 17, wherein a projection is formed on an outer surface of said other of the longitudinal side walls in compliance with recesses which are formed in the inner surface of said other of the longitudinal side walls for engagement with the latches.

* * * * *